US010914323B2

(12) United States Patent
Arikawa

(10) Patent No.: US 10,914,323 B2
(45) Date of Patent: Feb. 9, 2021

(54) ACCUMULATOR

(71) Applicant: EAGLE INDUSTRY CO., LTD., Tokyo (JP)

(72) Inventor: Tatsuhiro Arikawa, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/480,473

(22) PCT Filed: Jan. 26, 2018

(86) PCT No.: PCT/JP2018/002400
§ 371 (c)(1),
(2) Date: Jul. 24, 2019

(87) PCT Pub. No.: WO2018/143066
PCT Pub. Date: Aug. 9, 2018

(65) Prior Publication Data

US 2020/0003233 A1 Jan. 2, 2020

(30) Foreign Application Priority Data

Feb. 3, 2017 (JP) ..... 2017-018946

(51) Int. Cl.
*F16L 55/04* (2006.01)
*F15B 1/14* (2006.01)

(52) U.S. Cl.
CPC ..... *F15B 1/14* (2013.01)

(58) Field of Classification Search
CPC .... F15B 1/14; F15B 1/103; F15B 1/10; F15B 2201/20; F15B 1/106; F15B 20/007; F15B 2201/3153; F15B 2201/41
(Continued)

(56) References Cited

U.S. PATENT DOCUMENTS 3,456,673 A * 7/1969 Legrand ..... F15B 1/265 137/202
3,675,684 A 7/1972 Mercier et al. ..... 138/30
(Continued)

FOREIGN PATENT DOCUMENTS

CN 103842661 6/2014 ..... F15B 1/08
CN 103998792 8/2014 ..... F15B 1/08
(Continued)

OTHER PUBLICATIONS

International Search Report (w/translation) and Written Opinion (w/machine translation) issued in application No. PCT/JP2018/002400, dated Apr. 10, 2018 (12 pgs).
(Continued)

*Primary Examiner* — James F Hook
(74) *Attorney, Agent, or Firm* — Hayes Soloway P.C.

(57) ABSTRACT

The accumulator includes a housing having a sealing face and a fluid inlet/outlet passage; and a bellows fixed at one end to the housing such that an inner space of the housing is hermetically partitioned by the bellows into an interior and an exterior of the bellows. The bellows includes a bellows main body capable of expanding and contracting and a bellows cap provided with a sealing member covered with an elastic body that is opposed to and capable of being closely attached to the sealing face of the housing. The fluid inlet/outlet passage of the housing is closed upon a close attachment of the elastic body to the sealing face. The accumulator further includes a spacer placed between the housing and the bellows cap so as to surround the sealing member. The spacer has a communication passage providing communication between an inside and an outside of the spacer.

20 Claims, 9 Drawing Sheets

(58) Field of Classification Search
USPC ..... 138/30, 31
See application file for complete search history.

(56) References Cited

U.S. PATENT DOCUMENTS

| | | | | |
|---|---|---|---|---|
| 4,234,017 | A | 11/1980 | Mercier | 138/30 |
| 4,287,916 | A | 9/1981 | Sugimura et al. | 138/30 |
| 4,492,013 | A | 1/1985 | Porel | 138/30 |
| 4,526,205 | A | 7/1985 | Sugimura et al. | 138/30 |
| 5,215,124 | A | 6/1993 | Hattori et al. | 138/30 |
| 7,810,522 | B1 | 10/2010 | Nakoka et al. | 138/31 |
| 9,027,600 | B2 | 5/2015 | Yamashita | F16L 55/053 |
| 9,188,139 | B2 | 11/2015 | Yoshihara | F15B 1/08 |
| 9,328,746 | B2 | 5/2016 | Hyodo et al. | F15B 1/103 |
| 9,377,031 | B2 * | 6/2016 | Miyake | F15B 1/103 |
| 10,077,787 | B2 | 9/2018 | Arikawa | F15B 1/103 |
| 10,465,718 | B2 * | 11/2019 | Arikawa | F15B 1/106 |
| 10,480,539 | B2 * | 11/2019 | Arikawa | F15B 1/103 |
| 2003/0116209 | A1 * | 6/2003 | Umetsu | F15B 1/103 138/31 |
| 2011/0226370 | A1 * | 9/2011 | Arikawa | F15B 20/00 138/30 |
| 2012/0006438 | A1 * | 1/2012 | Nakaoka | F15B 1/103 138/30 |
| 2014/0311604 | A1 | 10/2014 | Yoshihara | F15B 1/08 |
| 2015/0204357 | A1 | 7/2015 | Hyodo et al. | F15B 1/103 |
| 2015/0240839 | A1 * | 8/2015 | Mizukami | F16L 55/053 138/31 |
| 2018/0306210 | A1 * | 10/2018 | Arikawa | F15B 1/103 |
| 2019/0360503 | A1 * | 11/2019 | Arikawa | F15B 1/14 |
| 2019/0368513 | A1 * | 12/2019 | Arikawa | F15B 1/103 |

FOREIGN PATENT DOCUMENTS

| | | | |
|---|---|---|---|
| CN | 104583606 | 4/2015 | F15B 1/08 |
| CN | 106030121 | 10/2016 | F15B 1/08 |
| JP | 2000249101 | 9/2000 | F15B 1/08 |
| JP | 2002155901 | 5/2002 | B60T 17/00 |
| JP | 2003222101 | 8/2003 | F15B 1/08 |
| JP | 2006010005 | 1/2006 | F15B 1/08 |
| JP | 2007092782 | 4/2007 | F15B 1/08 |
| JP | 3148349 | 2/2009 | F15B 1/08 |
| JP | 2009236137 | 10/2009 | F15B 1/24 |
| JP | 4384942 | 12/2009 | F15B 1/08 |
| JP | 2010121637 | 6/2010 | F15B 1/08 |
| JP | 2012097829 | 5/2012 | F15B 1/08 |
| JP | 2015158223 | 9/2015 | F15B 1/08 |
| WO | WO2013187165 | 12/2013 | F15B 1/08 |

OTHER PUBLICATIONS

Chinese Office Action (w/translation) issued in application No. 201880008446.5, dated Jan. 2, 2020 (12 pgs).
International Preliminary Report on Patentability issued in application No. PCT/JP2018/002400, dated Aug. 15, 2019 (8 pgs).
International Preliminary Report on Patentability issued in application No. PCT/JP2018/002111, dated Aug. 15, 2019 (6 pgs).
International Search Report and Written Opinion (w/translations) issued in application No. PCT/JP2018/002111, dated Apr. 3, 2018 (10 pgs).
International Preliminary Report on Patentability issued in application No. PCT/JP2018/002399, dated Aug. 15, 2019 (7 pgs).
International Search Report (w/translation) and Written Opinion (w/machine translation) issued in application No. PCT/JP2018/002399, dated Apr. 10, 2018 (12 pgs).
Chinese Office Action (w/translation) issued in application No. 201880008446.5, dated Jul. 16, 2020 (14 pgs).
Office Action issued in U.S. Appl. No. 16/480,653, dated Aug. 6, 2020, 27 pages.
Office Action issued in U.S. Appl. No. 16/477,157, dated Sep. 4, 2020, 24 pages.

* cited by examiner (a)

(b)

(a)

(b)

(a)

(b)

ACCUMULATOR

TECHNICAL FIELD

The present invention relates to an accumulator used in an automobile hydraulic system, an industrial equipment hydraulic system, etc., as a pressure storage device, a pulsation damper, etc.

BACKGROUND ART

A hydraulic circuit of a hydraulic control device for an automobile, an industrial equipment, etc. is provided with an accumulator for performing pressure storage, pulsation damping (buffering), etc. In such an accumulator, a bellows is arranged in a housing, the bellows is formed by a bellows main body whose fixed end is welded and fixed to the housing, and a bellows cap attached to the other end of the bellows main body, and by the bellows main body and the bellows cap, an internal space of the housing is partitioned into a gas chamber in which a gas is enclosed, and a liquid chamber communicating with a fluid inlet/outlet passage which is connected to the hydraulic circuit in a sealed state. In the bellows, upon receiving a liquid flowing into the liquid chamber from the hydraulic circuit via the fluid inlet/outlet passage, the bellows main body is expanded and contracted so as to balance gas pressure in the gas chamber and liquid pressure in the liquid chamber, so that a pressure storage operation, a pulsation damping operation, etc. (steady operation) is performed (refer to Patent Citation 1).

A sealing member formed by a disc-shaped elastic member is attached to the outside surface (i.e., a surface on the liquid chamber side) of the bellows cap partially forming the bellows. By this, for example, in accordance with discharge of the liquid stored in the liquid chamber, the bellows is expanded by the gas pressure in the bellows, and the sealing member is brought into close contact with a sealing face provided in the liquid chamber. Thereby, it is possible to close the fluid inlet/outlet passage provided on the sealing face. Therefore, by locking part of the liquid in the liquid chamber, it is possible to balance the liquid pressure in the liquid chamber and the gas pressure in the gas chamber. Thus, it is possible to prevent breakage, etc. of the bellows.

CITATION LIST

{Patent Literature}

Patent Citation 1: JP 2007-92782 A (Page 4, FIG. 1)

SUMMARY OF INVENTION

Technical Problem

However, in a case where fire, etc. occurs in an automobile, a facility, etc. provided with such an accumulator disclosed in Patent Citation 1, by the elastic member forming the sealing member being melt and burnt out due to a high temperature and the outer surface side of the exposed bellows cap being abutted with the sealing face, the fluid inlet/outlet passage is closed, and the gas pressure in the bellows is radically increased and the liquid in the liquid chamber is expanded due to a high temperature. Thus, there might be a risk that the housing is broken.

The present invention is achieved focusing on such a problem, and an object thereof is to provide an accumulator in which the pressure in a housing can be released when a temperature becomes high due to fire, etc.

Solution to Problem

In order to solve the foregoing problem, an accumulator according to a first aspect of the present invention, includes: a housing having a sealing face and a fluid inlet/outlet passage; and a bellows fixed at one end to the housing such that an inner space of the housing is hermetically partitioned by the bellows into an interior and an exterior of the bellows. The bellows includes a bellows main body capable of expanding and contracting and a bellows cap provided with a sealing member covered with an elastic body that is opposed to and capable of being closely attached to the sealing face of the housing. The fluid inlet/outlet passage of the housing is closed upon a close attachment of the elastic body to the sealing face.

The accumulator further includes a spacer placed between the housing and the bellows cap so as to surround the sealing member. The spacer has a communication passage providing communication between an inside and an outside of the spacer.

According to the first aspect, in a state where the elastic body of the sealing member is melt and burnt out due to a high temperature of fire, etc. and the bellows cap is exposed, it is possible to form a pressure releasing flow passage to release the fluid, which flows from the outside of the spacer into the inside of the spacer via the communication passage provided in the spacer, to the fluid inlet/outlet passage through a space which is retained between the bellows cap and the sealing face of the housing as a result that the spacer prevents the contact between the bellows cap and the sealing face. Thus, it is possible to release the pressure in the housing.

In the accumulator according to a second aspect of the present invention, the spacer is formed in an annular shape, and the communication passage is defined by a through hole formed in the spacer so as to pass through the spacer in the radial direction.

According to the second aspect, it is possible to protect the sealing member over the circumferential direction on the outer diameter side by the spacer, and in a state where the elastic body of the sealing member is melt and burnt out due to a high temperature of fire, etc. and the bellows cap is exposed, it is possible to form a pressure releasing flow passage to release the fluid, which flows from the outside of the spacer into the inside of the spacer via the communication passage provided in the spacer, to the fluid inlet/outlet passage through a space which is retained between the bellows cap and the sealing face of the housing as a result that the spacer prevents the contact between the bellows cap and the sealing face.

In the accumulator according to a third aspect of the present invention, the spacer is provided in a recess portion of the bellows cap or the housing recessed in an axial direction.

According to the third aspect, it is possible to extend axial length of the spacer by the depth of the recess portion recessed in the axial direction. Thus, it is possible to enlarge the through hole provided in the spacer.

In the accumulator according to a fourth aspect of the present invention, the spacer is fixed to the bellows cap.

According to the fourth aspect, relative positions in the radial direction of the spacer and the sealing member are unchanged. Thus, it is possible to reliably protect the sealing member by the spacer.

In the accumulator according to a fifth aspect of the present invention, the plural through holes are arranged in a circumferential direction.

According to the fifth aspect, the plural through holes forming a pressure releasing flow passage are arranged in the circumferential direction. Thus, it is possible to ensure a flow rate of the pressure releasing flow passage and to release the fluid to the fluid inlet/outlet passage for a short time.

In the accumulator according to a sixth aspect of the present invention, a groove portion extending in the radial direction on the inner diameter side of the spacer is provided in the bellows cap.

According to the sixth aspect, in a state where the elastic body of the sealing member is melt and burnt out due to a high temperature of fire, etc. and the bellows cap is exposed, it is possible to form a pressure releasing flow passage to release the fluid, which flows from the outside of the spacer into the inside of the spacer via the communication passage provided in the spacer, to the fluid inlet/outlet passage through a space which is retained between the bellows cap and the sealing face of the housing as a result that the spacer prevents the contact between the bellows cap and the sealing face, and in addition, through the groove portion provided in the bellows cap. Thus, the fluid is easily released to the fluid inlet/outlet passage.

In the accumulator according to a seventh aspect of the present invention, the communication passage and the groove portion are aligned in the radial direction.

According to the seventh aspect, since the communication passage and the groove portion are closely aligned to each other, it is possible to let the fluid efficiently flow to the fluid inlet/outlet passage by the pressure releasing flow passage.

In the accumulator according to an eighth aspect of the present invention, the groove portion is closed by covering with the sealing member.

According to the eighth aspect, the groove portion provided in the bellows cap is closed by covering with the sealing member. Thus, no fluid comes in between the bellows cap and of the elastic body of the sealing member, and an attached state of the elastic body of the sealing member to the bellows cap is easily maintained.

In the accumulator according to a ninth aspect of the present invention, the fluid inlet/outlet passage has, on a side of the inner space of the housing, an opening portion formed in a funnel shape gradually spreading toward an open end thereof.

According to the ninth aspect, in a state where the elastic body of the sealing member is melt and burnt out due to a high temperature of fire, etc. and the opening portion of the fluid inlet/outlet passage is covered by the exposed bellows cap, and even in a case where the bellows cap is warped to the fluid inlet/outlet passage side due to a high temperature, etc., by the funnel shape, the opening portion of the fluid inlet/outlet passage is prevented from being closed.

In the accumulator according to a tenth aspect of the present invention, a groove portion extending along an inclined portion of the funnel shape is provided.

According to the tenth aspect, in a state where the elastic member forming the sealing member is melt and burnt out due to a high temperature of fire, etc. and the opening portion of the fluid inlet/outlet passage is covered by the exposed bellows cap, and even in a case where the warped bellows cap is brought into contact with the opening portion of the fluid inlet/outlet passage, it is possible to release the fluid to the fluid inlet/outlet passage through the groove portion of the opening portion.

BRIEF DESCRIPTION OF DRAWINGS

FIG. 5A is a partial sectional view showing a state where the sealing member and the sealing face are closely attached to each other; and FIG. 5B is a partial sectional view showing a state where the elastic body of the sealing member is melt and burnt out and a pressure releasing flow passage is formed.

FIG. 7A is a partial sectional view showing a state where the sealing member and the sealing face are closely attached to each other; and FIG. 7B is a partial sectional view showing a state where the elastic body of the sealing member is melt and burnt out and a pressure releasing flow passage is formed.

FIG. 8A is a partial sectional view showing a state where the sealing member and a sealing face are closely attached to each other; and FIG. 8B is a partial sectional view showing a state where the elastic body of the sealing member is melt and burnt out and a pressure releasing flow passage is formed.

DESCRIPTION OF EMBODIMENTS

Modes for carrying out the accumulator according to the present invention will be described below based on embodiments.

First Embodiment

An accumulator according to the first embodiment of the present invention will be described with reference to FIGS. 1 to 4. Hereinafter, the near side of the paper plane of FIG. 1 will serve as the front face side (front side) of the accumulator, and description will be given with the up and down direction and the left and right direction when seen from the front side as a standard.

An accumulator 1 is used in, for example, an automobile hydraulic system, an industrial equipment hydraulic system, etc., as a pressure storage device, a pulsation damper, etc. The accumulator is a metal bellows type accumulator in which a bellows main body 31 is made of metal and capable of expanding and contracting.

Figure 1:
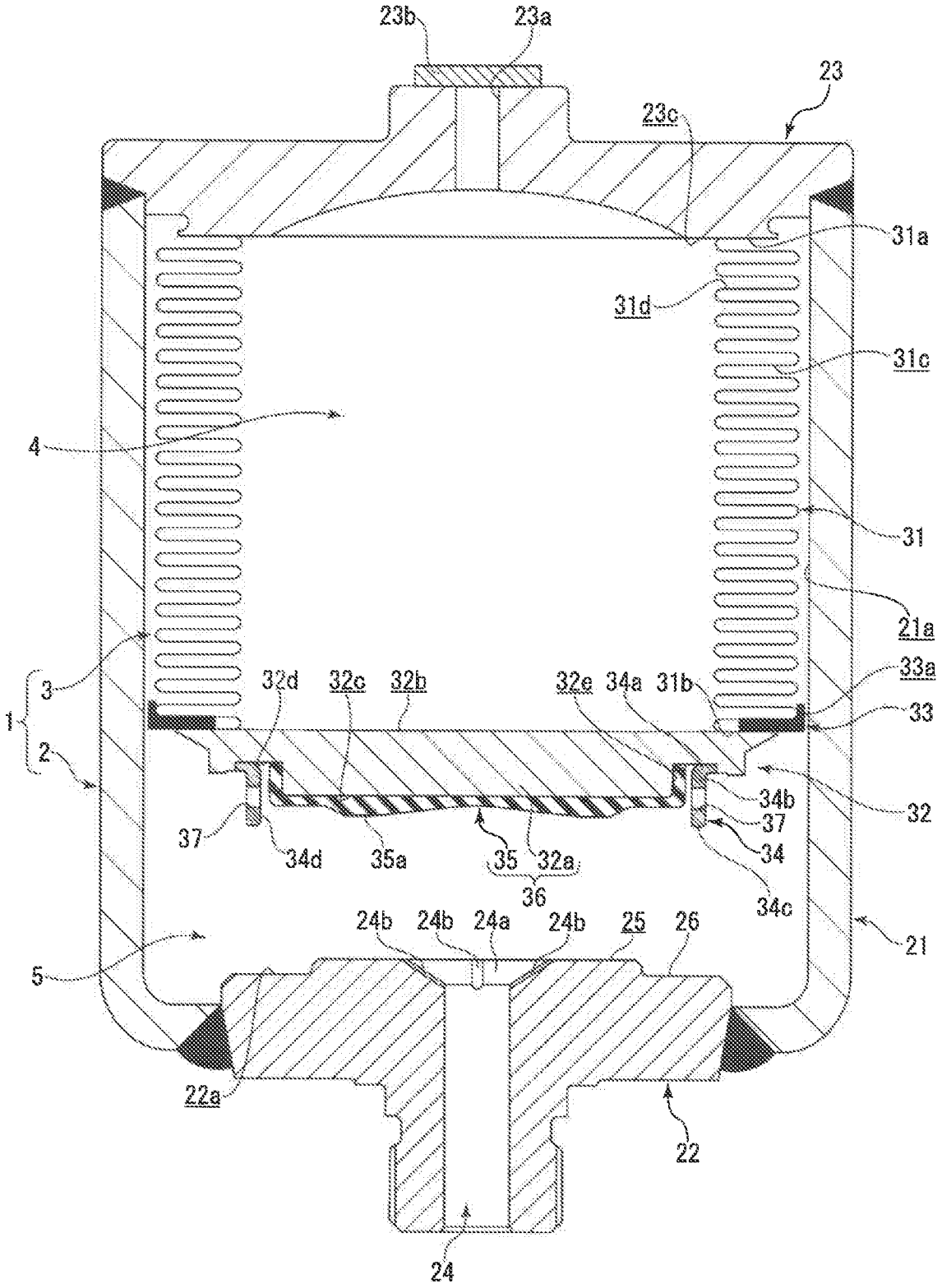
FIG. 1 is a sectional view showing a structure of an accumulator according to a first embodiment of the present invention.

As shown in FIG. 1, the accumulator 1 is mainly constituted by a housing 2, and a bellows 3 provided in an inner space of the housing 2. FIG. 1 shows a state where the bellows main body 31 to be described later is contracted by pressure of a stored liquid, etc.

The housing 2 includes a cylindrical shell 21 whose ends are both open, an oil port member 22 welded and fixed so as to close a lower end of the shell 21, and a gas enclosing member 23 welded and fixed so as to close an upper end of the shell 21.

The gas enclosing member 23 is provided with a gas enclosing port 23*a* for charging high-pressure gas (for example, nitrogen gas) to a gas chamber 4 defined in the housing 2, the gas chamber to be described later. The gas enclosing port 23*a* is closed by a gas plug 23*b* after charging the high-pressure gas.

The oil port member 22 is provided with a fluid inlet/outlet passage 24 for allowing a liquid (for example, working oil) to flow into and out of the housing through a pressure pipe (not shown). In the fluid inlet/outlet passage 24, an opening portion 24*a* is formed in a funnel shape gradually spreading upward, and plural groove portions 24*b*, 24*b*, . . . extending along inclination of the funnel shape are formed.

In the oil port member 22, an annular sealing face 25 is formed on the outer diameter side of the opening portion 24*a* of the fluid inlet/outlet passage 24. Further, on the outer diameter side of the sealing face 25, an annular face portion 26 is formed at a position lower than the sealing face 25.

The bellows 3 includes a metal bellows cap 32 formed in a disc shape in addition to the metal bellows main body 31 formed in a substantially cylindrical shape whose upper and lower ends are both open.

The bellows main body 31 is welded and fixed to an inner face 23*c* of the gas enclosing member 23 so as to close a fixed end 31*a* forming an upper end, and welded and fixed to an upper face 32*b* of the bellows cap 32 so as to close a playing end 31*b* forming a lower end in a state where an annular protection ring 33 is sandwiched between the playing end 31*b* of the bellows main body 31 and the upper face 32*b* of the bellows cap 32.

The protection ring 33 protects the bellows main body 31 so that the bellows main body 31 is not brought into direct contact with an inner wall face 21*a* of the shell 21. An outer circumferential face 33*a* of the protection ring 33 and the inner wall face 21*a* of the shell 21 are slightly separated from each other in the radial direction, and hence capable of smoothly sliding without interfering with expansion and contraction operations of the bellows 3.

A columnar projecting portion 32*a* projecting downward is formed in an inner diameter side center portion of the bellows cap 32. An elastic body 35 (made of, for example, rubber) is closely attached (by, for example, vulcanization bonding) to a flat lower face 32*c* and an outer circumferential face 32*e* of the projecting portion 32*a*. In the present embodiment, a combination of the projecting portion 32*a* of the bellows cap 32 and the elastic body 35 form a sealing member 36. Further, the elastic body 35 may be attached only to the lower face 32*c* of the projecting portion 32*a*.

Further, an annular recess portion 32*d* (recess portion) recessed upward in the axial direction is formed on the outer diameter side of the projecting portion 32*a*. An annular spacer 34 formed in a reversed L shape in a sectional view is fitted to the outer diameter side of the annular recess portion 32*d*. Structures of the spacer 34 and the sealing member 36 will be described in detail later.

An internal space of the housing 2 is partitioned by the bellows 3 (formed by the bellows main body 31 and the bellows cap 32) into the gas chamber 4 communicating with the gas enclosing port 23*a* and a liquid chamber 5 communicating with the fluid inlet/outlet passage 24 in a sealed state.

The gas chamber 4 is defined by the inner face 23*c* of the gas enclosing member 23, an inner circumferential face 31*d* of the bellows main body 31, and the upper face 32*b* of the bellows cap 32. The high-pressure gas charged from the gas enclosing port 23*a* is enclosed in the gas chamber 4.

The liquid chamber 5 is defined by the inner wall face 21*a* of the shell 21, an inner face 22*a* of the oil port member 22, an outer circumferential face 31*c* of the bellows main body 31, the bellows cap 32, the spacer 34, the elastic body 35 and an outer-diameter-side inner face of the gas enclosing member 23. The liquid flows into and out of the liquid chamber 5 via the fluid inlet/outlet passage 24 communicating with the pressure pipe (not shown).

In the accumulator 1, by the expansion and contraction operations of the bellows 3 provided in the housing 2, the bellows cap 32 is moved to a certain position and gas pressure of the gas chamber 4, and liquid pressure of the liquid chamber 5 are balanced, thereby adjusting the pressure of the liquid.

Figure 2:
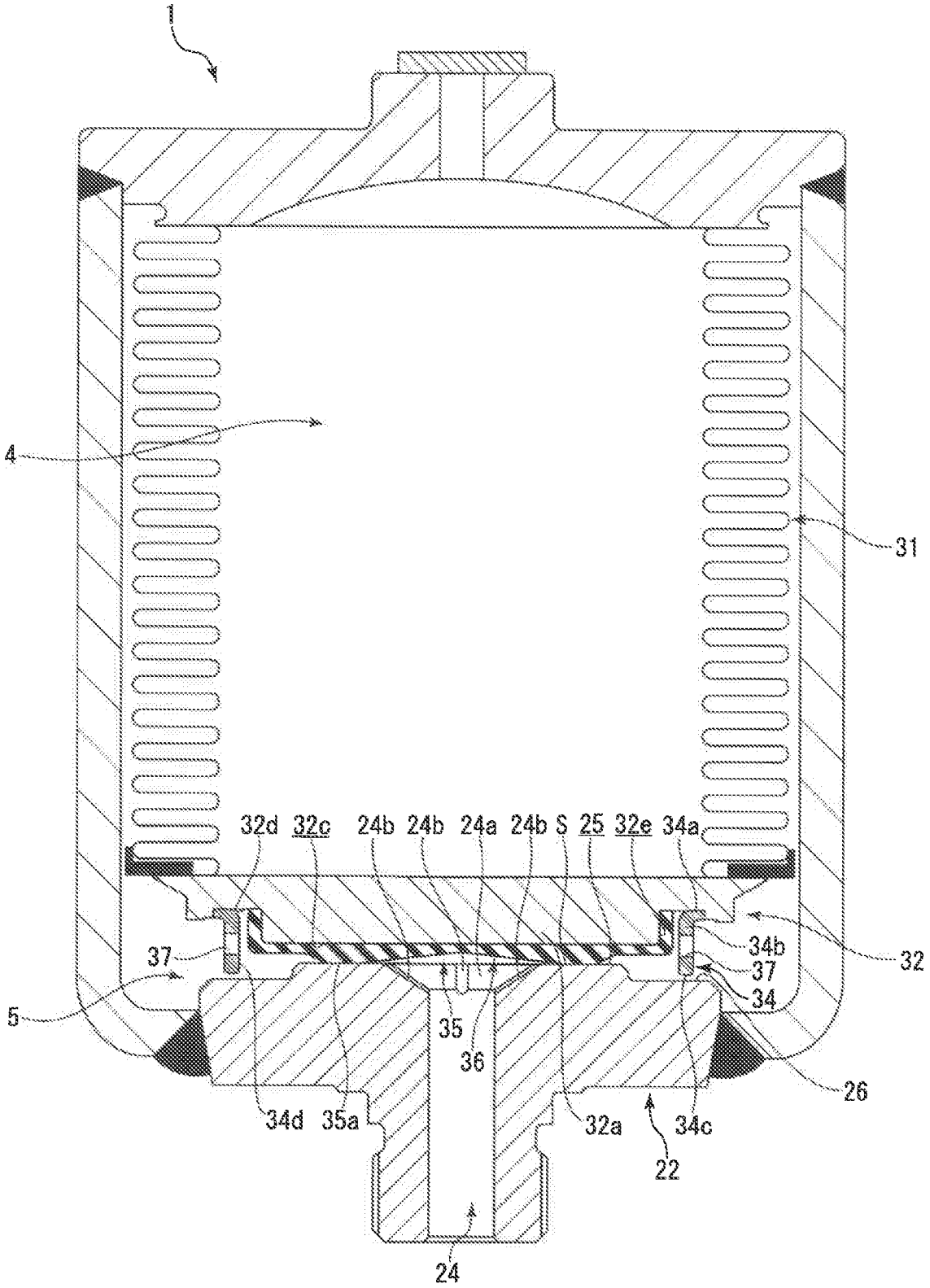
FIG. 2 is a sectional view showing a state where a sealing member and a sealing face of the accumulator shown in FIG. 1 are closely attached to each other.

For example, as shown in FIG. 2, when the liquid in the pressure pipe communicating with the fluid inlet/outlet passage 24 is discharged, the bellows cap 32 receives the gas pressure of the gas chamber 4 and moves downward, and the bellows main body 31 is expanded. Thereby, an annular projecting portion 35*a* (described later) of the elastic body 35 attached to the projecting portion 32*a* of the bellows cap 32, that is, the sealing member 36 and the sealing face 25 of the oil port member 22 are closely attached to each other so as to form an annular sealing portion S, and the opening portion 24*a* of the fluid inlet/outlet passage 24 is closed. Thereby, part of the liquid is locked in the liquid chamber 5, and pressure of this locked liquid and the gas pressure of the gas chamber 4 are balanced. Thus, no excessive stress is applied to the bellows main body 31, so that it is possible to suppress breakage of the bellows main body 31. A normal operation of the accumulator 1 in which, as described above, by expanding the bellows 3 and closely attaching the sealing member 36 and the sealing face 25 to each other, the sealing portion S is formed and the opening portion 24*a* of the fluid inlet/outlet passage 24 is closed will be referred to as the steady operation of the accumulator 1.

Next, the structures of the spacer 34 and the sealing member 36 will be described in detail. As shown in FIGS. 1 and 2, the spacer 34 is formed by pressing a metal disc plate into a reversed L shape in a sectional view. The spacer 34 is mainly formed by an outward-flange-shaped fixed portion 34*a* forming an upper end of the spacer 34, the fixed portion being welded and fixed to the outer diameter side of the annular recess portion 32*d* of the bellows cap 32 in a fitted state, and a tubular portion 34*b* extending downward from the fixed portion 34*a*.

In the spacer 34, an opening portion 34*d* which is open in the up and down direction is formed by an inner diameter part of the tubular portion 34*b*. The elastic body 35 attached to the lower face 32*c* and the outer circumferential face 32*e* of the projecting portion 32*a* of the bellows cap 32 is arranged on the inner diameter side of the opening portion 34*d* (refer to FIGS. 1 and 3). Regarding the bellows cap 32, only the structure on the inner diameter side of the annular recess portion 32*d* where the spacer 34 and the sealing member 36 are provided is shown in FIG. 3.

Figure 3:
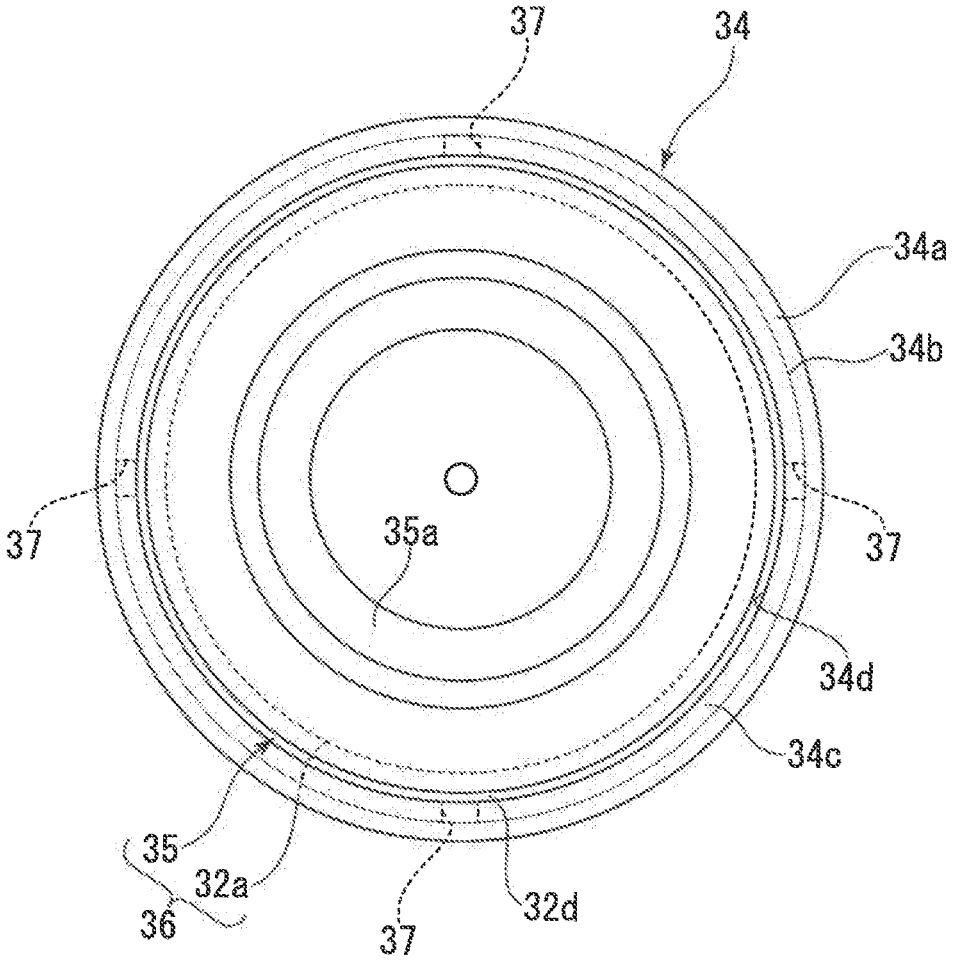
FIG. 3 is a bottom view showing structures of the sealing member and a spacer in the first embodiment.

As shown in FIGS. 1 to 3, plural through holes 37, 37, . . . (also referred to as communication passages) passing through in the radial direction are provided in the tubular portion 34*b* of the spacer 34 at predetermined intervals in the circumferential direction. The liquid chamber 5 (i.e., the outer diameter side of the spacer 34) and the inner diameter side of the spacer 34 communicate with each other via the through holes 37, 37, . . . .

The elastic body 35 partially forming the sealing member 36 is attached to the lower face 32*c* and the outer circumferential face 32*e* of the projecting portion 32*a* of the bellows cap 32. The annular projecting portion 35*a* projecting downward (toward the sealing face 25 side) is formed in the elastic body. By partially enhancing sealing face pressure of the sealing portion S at the time of closely attaching the sealing member 36 and the sealing face 25, a sealing performance is improved.

As shown in FIG. 2, at steady operation of the accumulator 1, in a state where the sealing member 36 and the sealing face 25 are closely attached to each other so as to form the sealing portion S, a lower end portion 34*c* of the spacer 34 is separated from the annular face portion 26 of the oil port member 22 in the up and down direction or the axial direction of the accumulator. Thereby, the sealing member 36 and the sealing face 25 are closely attached to each other. Thus, it is possible to reliably make sealing in the sealing portion S.

The sealing portion S of the sealing member 36 and the sealing face 25 is formed on the inner diameter side of the through holes 37, 37, . . . of the spacer 34. Thus, at steady operation of the accumulator 1, the liquid in the liquid chamber 5 flowing in from the through holes 37, 37, . . . is blocked by the sealing portion S and incapable of flowing into the fluid inlet/outlet passage 24. Further, the liquid in the liquid chamber 5 flowing in from a part where the lower end portion 34*c* of the spacer 34 and the annular face portion 26 of the oil port member 22 are separated from each other is also blocked by the sealing portion S and incapable of flowing into the fluid inlet/outlet passage 24.

At steady operation, the lower end portion 34*c* of the spacer 34 is separated from the annular face portion 26 of the oil port member 22 in the up and down direction. However, in a case where the gas pressure of the gas chamber 4 is increased, by abutting the lower end portion 34*c* of the spacer 34 with the annular face portion 26 of the oil port member 22, downward movement of the bellows cap 32 is regulated so that the elastic body 35 partially forming the sealing member 36 is not crushed excessively. Up-down size of the spacer 34 in the axial direction may be freely determined according to a material, thickness, etc. of the elastic body 35 as long as the sealing face pressure in the sealing portion S can be properly maintained.

As described above, in the spacer 34, the fixed portion 34*a* is welded and fixed to the annular recess portion 32*d* of the bellows cap 32 on the outer diameter side of the sealing member 36, and relative positions in the radial direction of the spacer 34 and the sealing member 36 are unchanged. Thus, even in a case where the bellows cap 32 is inclined or so at the time of expanding and contracting the bellows 3, the tubular portion 34*b* or the lower end portion 34*c* of the spacer 34 is brought into contact with the annular face portion 26 before the sealing member 36. Therefore, it is possible to reliably protect the sealing member 36 by the spacer 34 so that the sealing member 36 is not brought into contact with anything other than the sealing face 25.

The spacer 34 is arranged so as to be separated from an outer periphery face of the elastic body 35 of the sealing member 36. Thus, even when the lower end portion 34*c* is abutted with the annular face portion 26, the impact of the abutting is not easily transmitted to the elastic body 35, and the elastic body 35 is not easily dropped off the projecting portion 32*a* of the bellows cap 32.

Next, a pressure releasing flow passage formed for releasing the liquid in the liquid chamber 5 to the fluid inlet/outlet passage 24 in a state where the elastic body 35 of the sealing member 36 is melt and burnt out due to a high temperature of fire, etc. and the projecting portion 32*a* of the bellows cap 32 is exposed will be described. Hereinafter, only flows of the liquid in the pressure releasing flow passage formed on the right side on the paper plane will be shown by arrows in the figures.

Figure 4:
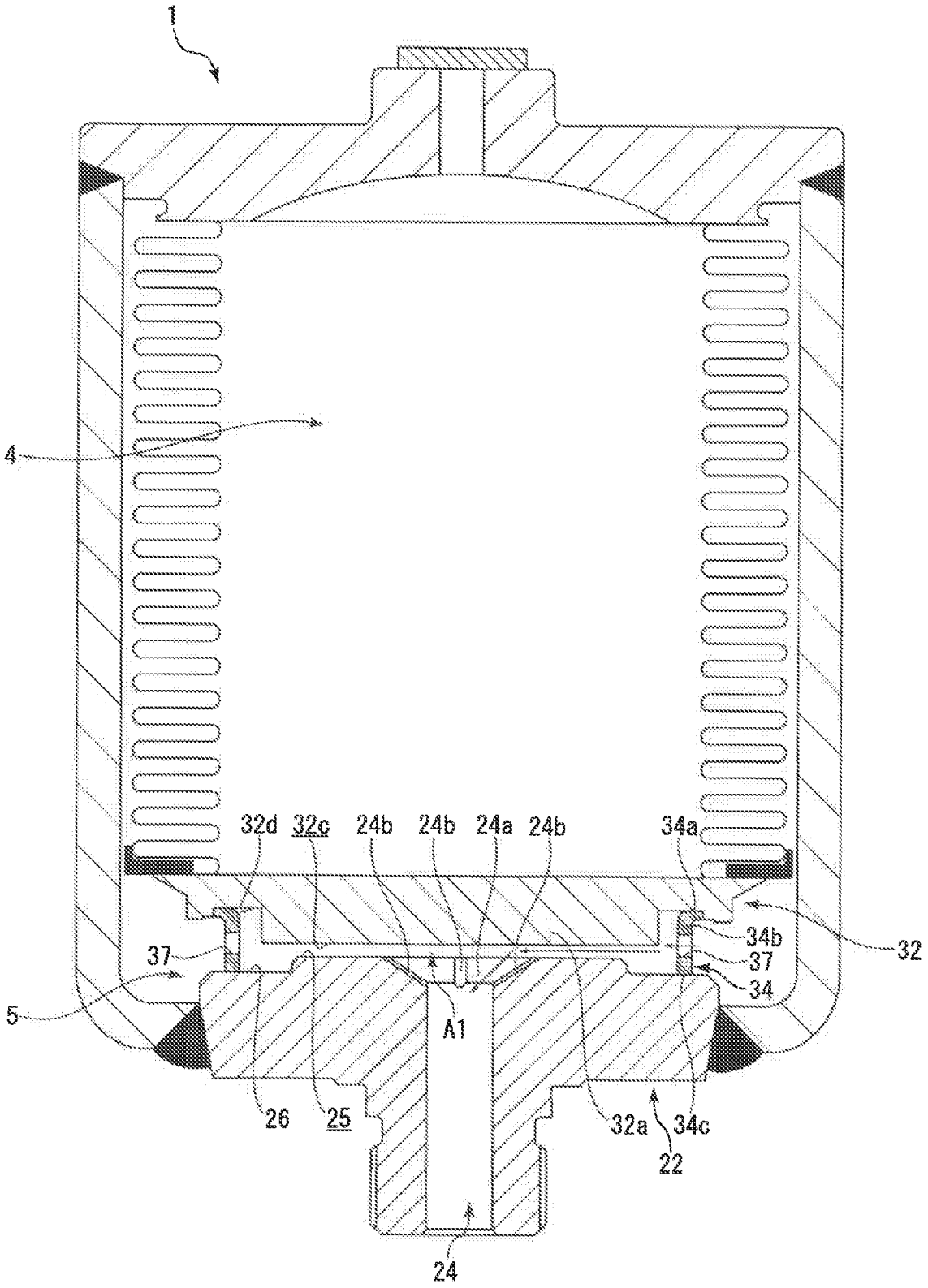
FIG. 4 is a sectional view showing a state where an elastic body of the sealing member of the accumulator shown in FIG. 2 is melt and burnt out and a pressure releasing flow passage is formed.

As shown in FIG. 4, in a state where the elastic body 35 of the sealing member 36 is melt and burnt out due to a high temperature of fire, etc. and the projecting portion 32*a* of the bellows cap 32 is exposed, the elastic body 35 (especially, annular projecting portion 35*a*) closely attached to the sealing face 25 is melt and burnt out. Thus, the lower end portion 34*c* of the spacer 34 is moved downward more than at steady operation and abutted with the annular face portion 26 of the oil port member 22.

Further, since the elastic body 35 of the sealing member 36 is melt and burnt out, it is possible to let the liquid of the liquid chamber 5 flowing in from the through holes 37, 37, . . . provided in the tubular portion 34*b* of the spacer 34 flow into a space A1 formed between the projecting portion 32*a* of the bellows cap 32 and the sealing face 25 by the spacer 34, the space A1 communicating with the fluid inlet/outlet passage 24.

Accordingly, in a state where the elastic body 35 of the sealing member 36 is melt and burnt out due to a high temperature of fire, etc., the projecting portion 32*a* of the bellows cap 32 is exposed, and the lower end portion 34*c* of the spacer 34 is abutted with the annular face portion 26 of the oil port member 22, it is possible to form a pressure releasing flow passage to release the liquid of the liquid chamber 5 flowing in from the through holes 37, 37, . . . which are provided in the tubular portion 34*b* of the spacer 34 to the fluid inlet/outlet passage 24 through the space A1 formed between the projecting portion 32*a* of the bellows cap 32 and the sealing face 25. Thus, it is possible to release the liquid of the liquid chamber 5 to the fluid inlet/outlet passage 24, and to suppress a radical increase in the pressure of the liquid chamber 5, and by extension, the pressure of the gas chamber 4.

The through holes 37, 37, . . . are provided in the tubular portion 34*b* of the spacer 34. Thus, at the time of melting and burning the elastic body 35, the liquid in the liquid chamber 5 immediately flows into the inner diameter side of the spacer 34 from the through holes 37, 37, . . . and it is possible to promptly lower the pressure of the liquid chamber 5. Further, even when the volume of the gas in the gas chamber 4 is increased due to a high temperature and the bellows main body 31 is inflated in the outer diameter direction, it is possible to appropriately release the liquid in the liquid chamber 5 to the fluid inlet/outlet passage 24.

As described above, the plural through holes 37, 37, . . . are provided in the circumferential direction. Thus, it is possible to ensure a flow rate of the pressure releasing flow passage, and to release the liquid from the liquid chamber 5 to the fluid inlet/outlet passage 24 for a short time.

In the spacer 34, the fixed portion 34*a* is welded and fixed to the annular recess portion 32*d* recessed upward in the bellows cap 32. Thus, it is possible to extend the up-down length of the spacer 34 by up-down size of the annular recess portion 32*d*. Thereby, it is possible to form large through holes 37, 37, . . . in the spacer 34. Thus, it is possible to ensure the flow rate of the pressure releasing flow passage and to release the liquid from the liquid chamber 5 to the fluid inlet/outlet passage 24 for a short time. Further, the lower end portion 34*c* of the spacer 34 is abutted with the annular face portion 26 recessed downward more than the sealing face 25 of the oil port member 22. Thus, it is possible to extend the up-down length of the spacer 34 more.

The spacer 34 is provided on the outer diameter side of the sealing member 36. Thus, residues, etc. of the elastic body 35 melt and burnt out due to a high temperature of fire, etc. do not easily clog the through holes 37, 37, . . . , and it is possible to reliably form the pressure releasing flow passage.

As shown in FIG. 4, in a state where the elastic body 35 forming the sealing member 36 is melt and burnt out due to a high temperature of fire, etc., the projecting portion 32*a* of the bellows cap 32 is exposed, and the lower end portion 34*c* of the spacer 34 is abutted with the annular face portion 26 of the oil port member 22, a height position of the through holes 37, 37, . . . provided in the spacer 34 and a height position of the space A1 formed between the projecting portion 32*a* of the bellows cap 32 and the sealing face 25 are substantially the same as each other. Thus, the liquid flowing in from the through holes 37, 37, . . . easily flows to the space A1.

In the spacer 34, the tubular portion 34*b* is formed in a linear shape in the up and down direction, in other words, the spacer does not have a curved portion bent to the inner diameter side or the outer diameter side in the lower end portion 34*c*. Thus, it is possible to ensure a large space on the inner diameter side of the spacer 34, in detail, a large space defined by the inner face side of the tubular portion 34*b* of the spacer 34, the annular face portion 26 of the oil port member 22, the projecting portion 32*a* of the bellows cap 32, and the annular recess portion 32*d* of the bellows cap 32. Therefore, the liquid of the liquid chamber 5 flowing in from the through holes 37, 37, . . . easily flows to the space A1 formed between the projecting portion 32*a* of the bellows cap 32 and the sealing face 25.

In the spacer 34, the tubular portion 34*b* is formed in a linear shape in the up and down direction. Thus, even in a case where the lower end portion 34*c* is abutted with the annular face portion 26 of the oil port member 22 in a slightly inclined state, after that, the entire lower end portion 34*c* is brought into contact over the circumferential direction with the abutted point of the lower end portion 34*c* as a starting point. Thus, a bending load does not easily act on the tubular portion 34*b*.

The spacer 34 has the configuration in which, as described above, the bending load does not easily act but a buckling load acts on the tubular portion 34*b*. Thus, in comparison to a configuration in which the bending load acts, structure strength is high and it is possible to downsize the spacer 34. Further, the spacer 34 is an annular ring member and has a simple structure. Thus, even in a situation where the elastic body 35 of the sealing member 36 is melt and burnt out due to a high temperature of fire, etc., the structure is maintained and the pressure releasing flow passage is easily formed.

As described above, in the fluid inlet/outlet passage 24, the opening portion 24*a* is formed in the funnel shape gradually spreading upward, and the groove portions 24*b*, 24*b*, . . . extending along the inclination of the funnel shape are formed. Thus, in a state where the projecting portion 32*a* of the bellows cap 32 is exposed and the lower end portion 34*c* of the spacer 34 is abutted with the annular face portion 26 of the oil port member 22, and even in a case where the bellows cap 32 is warped to the opening portion 24*a* side of the fluid inlet/outlet passage 24 due to a high temperature, etc., by the funnel shape, the opening portion 24*a* of the fluid inlet/outlet passage 24 is not easily closed. Even in a case where the opening portion 24*a* of the fluid inlet/outlet passage 24 is substantially closed by the warped bellows cap 32, it is possible to release the liquid of the liquid chamber 5 to the fluid inlet/outlet passage 24 through the groove portions 24*b*, 24*b*, . . . . Thus, it is possible to reliably form the pressure releasing flow passage.

It is possible to form the pressure releasing flow passage by the through holes 37, 37, . . . of the spacer 34. Thus, only by a task of newly attaching the spacer 34 to the outer diameter side of the sealing member 36, it is possible to form a pressure releasing flow passage in the accumulator.

Second Embodiment

Figure 5:
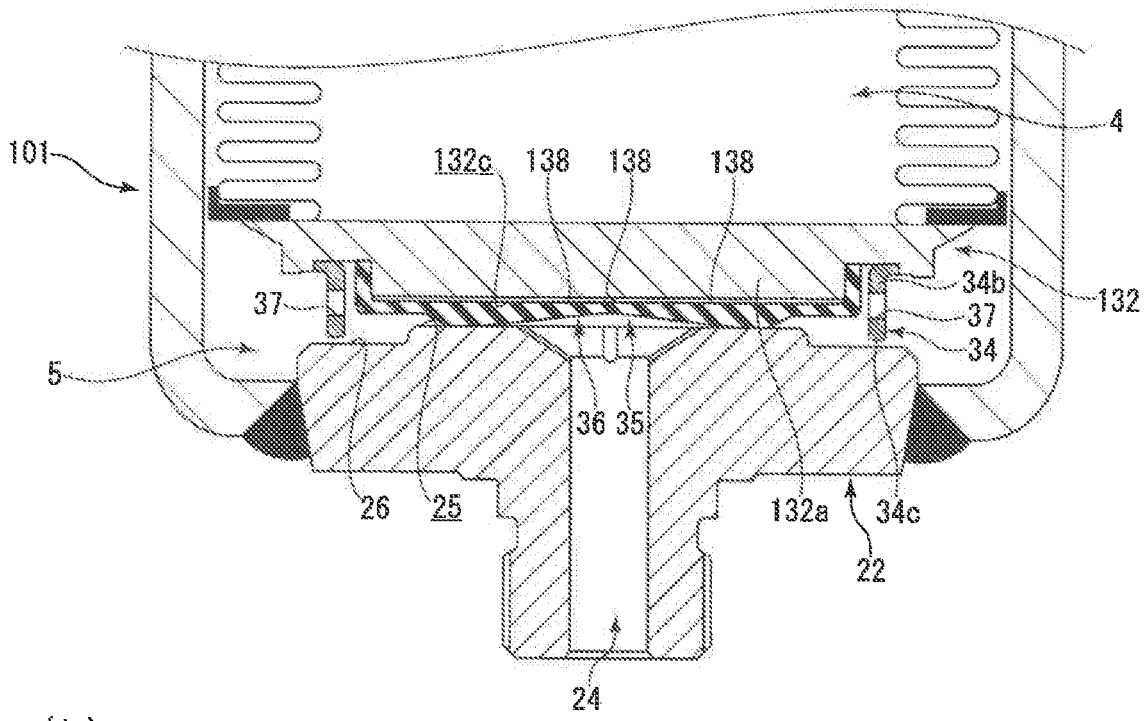
FIG. 5 shows sectional views of an accumulator according to a second embodiment of the present invention.
Figure 5:
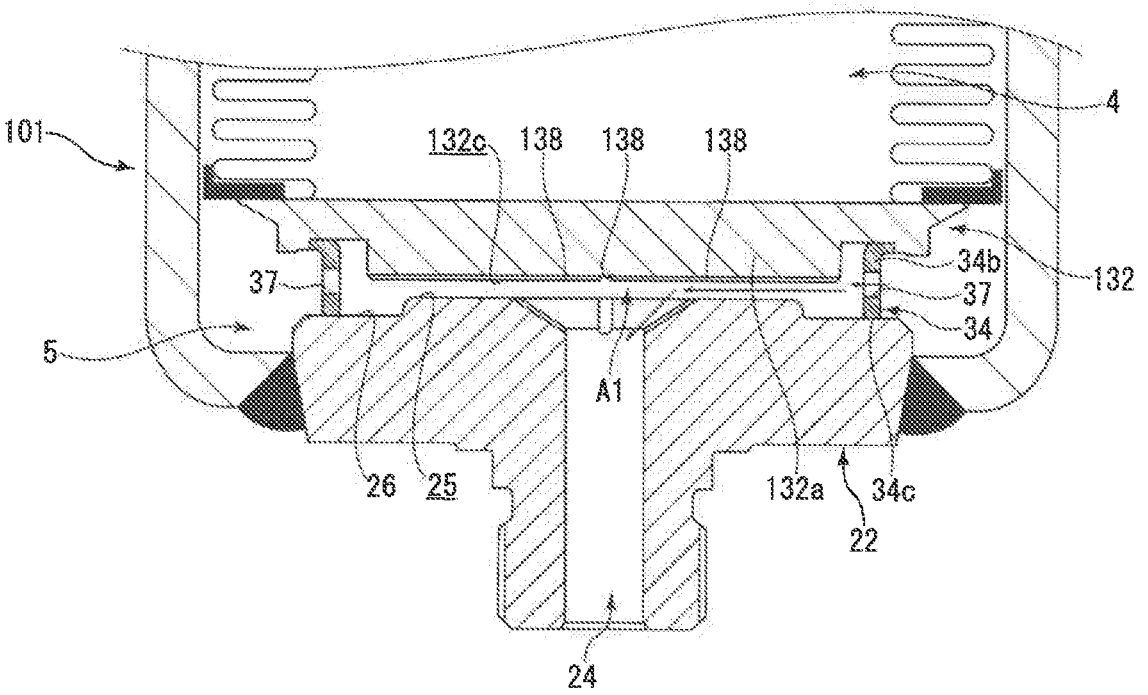

Next, an accumulator according to the second embodiment of the present invention will be described with reference to FIGS. 5 and 6. The same constituent parts as the constituent parts shown in the above embodiment will be given the same reference signs, and duplicated description will be omitted.

As shown in FIG. 5A, in an accumulator 101 in the second embodiment, the plural through holes 37, 37, . . . passing through in the radial direction are provided in the tubular portion 34*b* of the spacer 34 at predetermined intervals in the circumferential direction.

Figure 6:
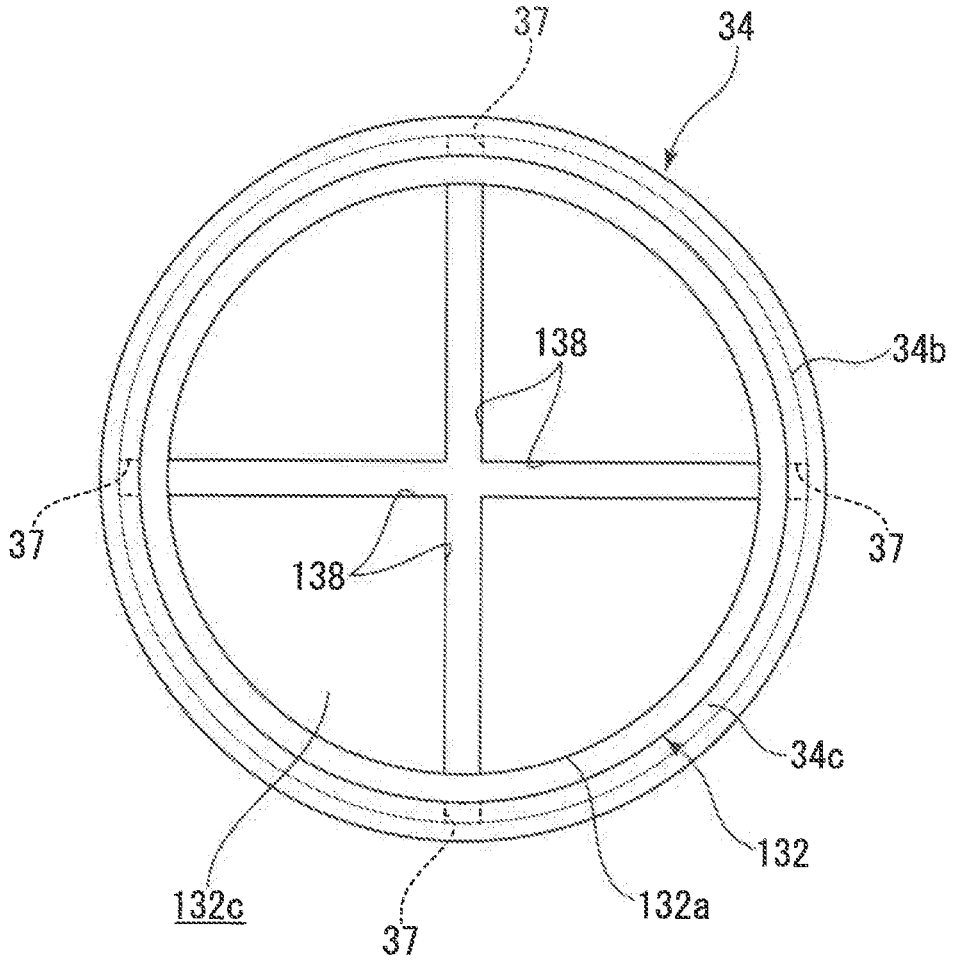
FIG. 6 is a bottom view showing structures of a bellows cap and the spacer shown in FIG. 5B.

On a lower face 132*c* of a cylindrical projecting portion 132*a* of a bellows cap 132, groove portions 138, 138, . . . extending in the radial direction so as to cross each other at the center of the lower face 132 are formed and arranged at predetermined intervals in the circumferential direction corresponding to circumferential positions of the through holes 37, 37, . . . of the spacer 34 (refer to FIG. 6). Further, the groove portions 138, 138, . . . are closed by covering with the elastic body 35 of the sealing member 36, and at steady operation, no liquid comes in between the projecting portion 132*a* of the bellows cap 132 and the elastic body 35. Thus, an attached state of the elastic body 35 to the projecting portion 132*a* of the bellows cap 132 is easily maintained.

Therefore, as shown in FIG. 5B, in a state where the elastic body 35 of the sealing member 36 is melt and burnt out due to a high temperature of fire, etc., the projecting portion 132*a* of the bellows cap 132 is exposed, and the lower end portion 34*c* of the spacer 34 is abutted with the annular face portion 26 of the oil port member 22, it is possible to form a pressure releasing flow passage to release the liquid of the liquid chamber 5 flowing in from the through holes 37, 37, . . . which are provided in the tubular portion 34*b* of the spacer 34 to the fluid inlet/outlet passage 24 through the space A1 formed between the projecting portion 132*a* of the bellows cap 132 and the sealing face 25 and in addition, through the groove portions 138, 138, . . . formed in the projecting portion 132*a* of the bellows cap 132. Thus, it is possible to increase a flow rate of the pressure releasing flow passage and the liquid of the liquid chamber 5 is easily released to the fluid inlet/outlet passage 24. In addition, since it is possible to promptly release the liquid of the liquid chamber 5 to the fluid inlet/outlet passage 24, it is possible to suppress a radical increase in the pressure of the liquid chamber 5, and by extension, the pressure of the gas chamber 4.

Each of the through holes 37, 37, . . . and each of the groove portions 138, 138, . . . which are close to each other are aligned in the radial direction. Thus, it is possible to efficiently release the liquid from the liquid chamber 5 to the fluid inlet/outlet passage 24 by the pressure releasing flow passage. Further, the through holes 37, 37, . . . and the groove portions 138, 138, . . . are arranged in a substantially radial manner. Thus, it is possible to efficiently release the liquid from the liquid chamber 5 to the fluid inlet/outlet passage 24.

Third Embodiment

Figure 7:
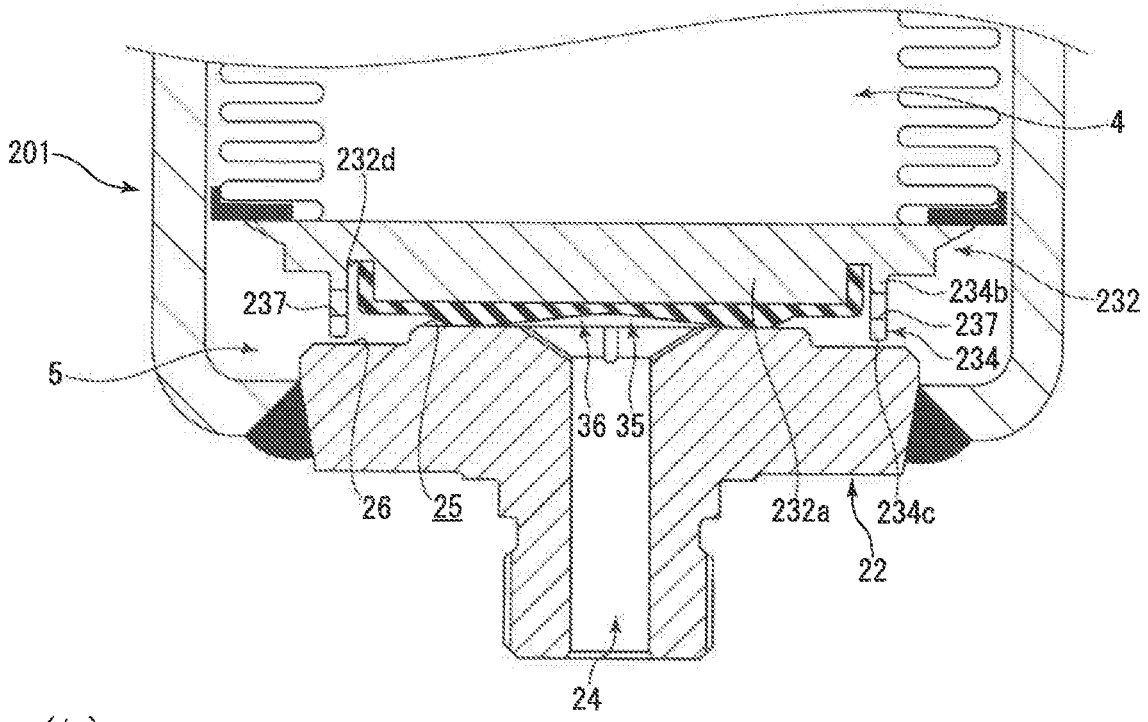
FIG. 7 shows sectional view of an accumulator according to a third embodiment of the present invention.
Figure 7:
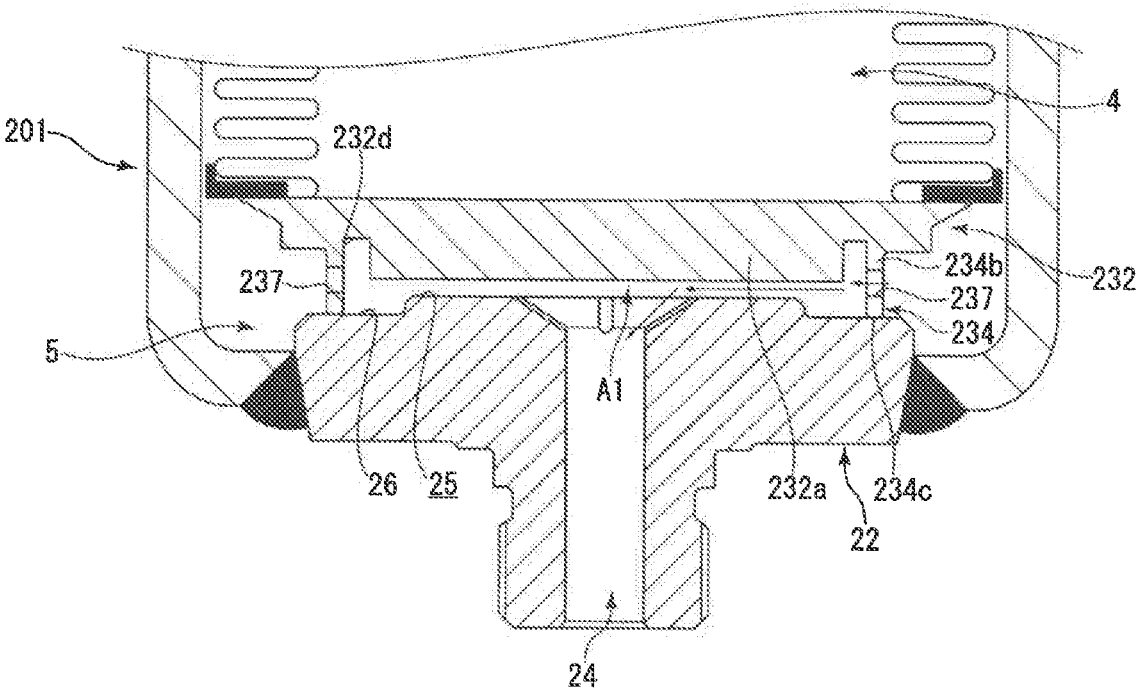

Next, an accumulator according to the third embodiment of the present invention will be described with reference to FIG. 7. The same constituent parts as the constituent parts shown in the above embodiments will be given the same reference signs, and duplicated description will be omitted.

As shown in FIG. 7A, in an accumulator 201 in the third embodiment, an annular spacer 234 projecting downward from an annular recess portion 232*d* of a bellows cap 232 is provided, and plural through holes 237, 237, . . . passing through in the radial direction are provided in a tubular portion 234*b* of the spacer 234 at predetermined intervals in the circumferential direction.

Therefore, as shown in FIG. 7B, in a state where the elastic body 35 forming the sealing member 36 is melt and burnt out due to a high temperature of fire, etc., a projecting portion 232*a* of the bellows cap 232 is exposed, and a lower end portion 234*c* of the spacer 234 is abutted with the annular face portion 26 of the oil port member 22, it is possible to form a pressure releasing flow passage to release the liquid of the liquid chamber 5 flowing in from the through holes 237, 237, . . . which are provided in the tubular portion 234*b* of the spacer 234 to the fluid inlet/outlet passage 24 through the space A1 formed between the projecting portion 232*a* of the bellows cap 232 and the sealing face 25. Thus, it is possible to release the liquid of the liquid chamber 5 to the fluid inlet/outlet passage 24, and to suppress a radical increase in the pressure of the liquid chamber 5, and by extension, the pressure of the gas chamber 4.

The spacer 234 is integrated with the bellows cap 232. Thus, structure strength is enhanced, and it is possible to reduce the assembling man-hour for forming the pressure releasing flow passage in the accumulator.

Fourth Embodiment

Figure 8:
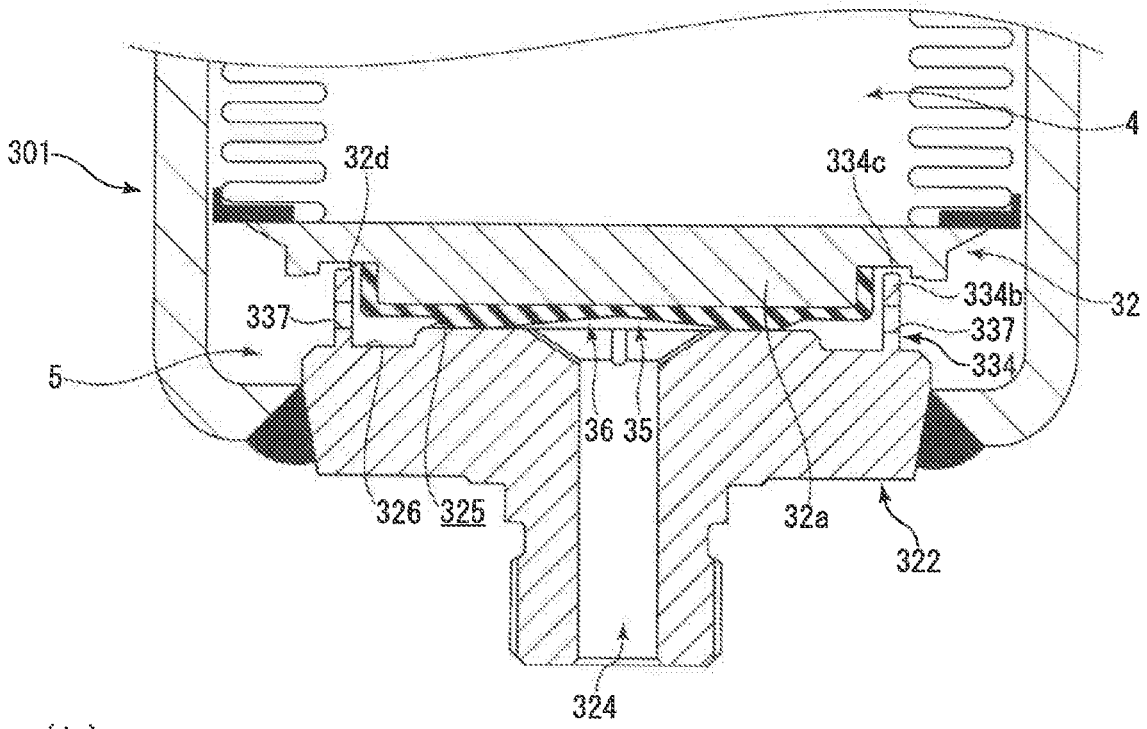
FIG. 8 shows sectional view of an accumulator according to a fourth embodiment of the present invention.
Figure 8:
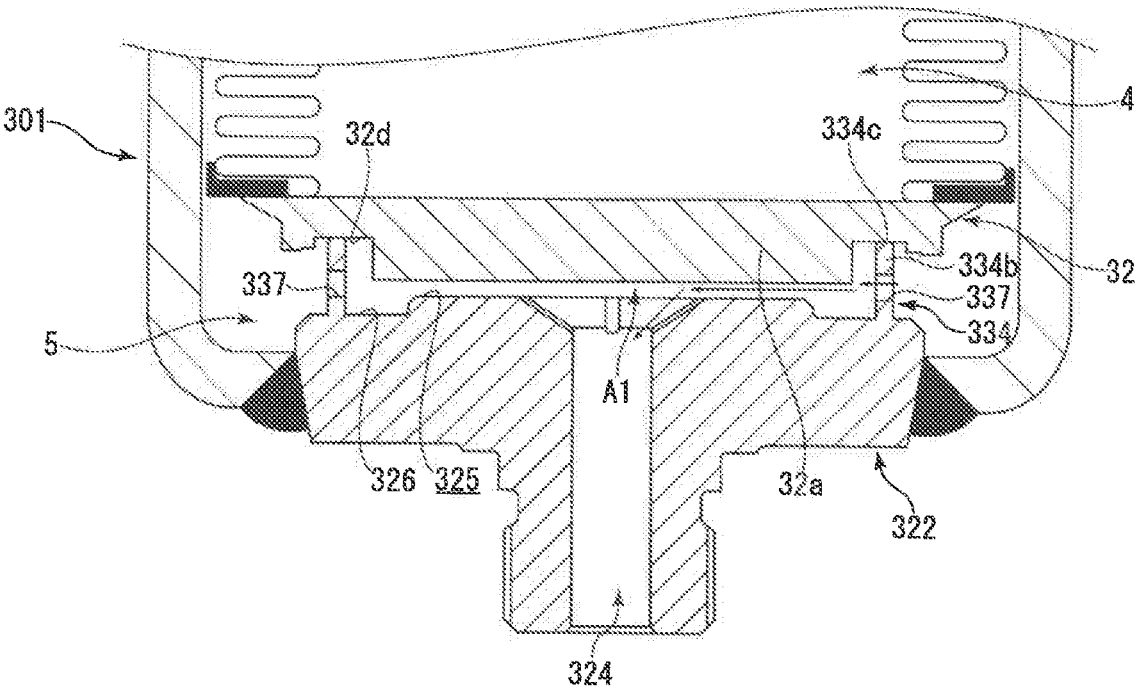

Next, an accumulator according to the fourth embodiment of the present invention will be described with reference to FIG. 8. The same constituent parts as the constituent parts shown in the above embodiments will be given the same reference signs, and duplicated description will be omitted.

As shown in FIG. 8A, in an accumulator 301 in the fourth embodiment, an annular spacer 334 projecting upward from the outer diameter side of an annular face portion 326 of an oil port member 322 is provided, and plural through holes 337, 337, . . . passing through in the radial direction are formed in a tubular portion 334*b* of the spacer 334 at predetermined intervals in the circumferential direction.

Therefore, as shown in FIG. 8B, in a state where the elastic body 35 of the sealing member 36 is melt and burnt out due to a high temperature of fire, etc., the projecting portion 32*a* of the bellows cap 32 is exposed, and an upper end portion 334*c* of the spacer 334 is abutted with the annular recess portion 32*d* of the bellows cap 32, it is possible to form a pressure releasing flow passage to release the liquid of the liquid chamber 5 flowing in from the through holes 337, 337, . . . which are provided in the tubular portion 334*b* of the spacer 334 to a fluid inlet/outlet passage 324 through the space A1 formed between the projecting portion 32*a* of the bellows cap 32 and a sealing face 325. Thus, it is possible to release the liquid of the liquid chamber 5 to the fluid inlet/outlet passage 324, and to suppress a radical increase in the pressure of the liquid chamber 5, and by extension, the pressure of the gas chamber 4.

The spacer 334 is integrated with the oil port member 322. Thus, structure strength is enhanced, and it is possible to reduce the assembling man-hour for forming the pressure releasing flow passage in the accumulator.

As above, the embodiments of the present invention are described with the drawings. However, specific configurations are not limited to these embodiments but changes and additions within the range not departing from the gist of the present invention are included in the present invention.

Figure 9:
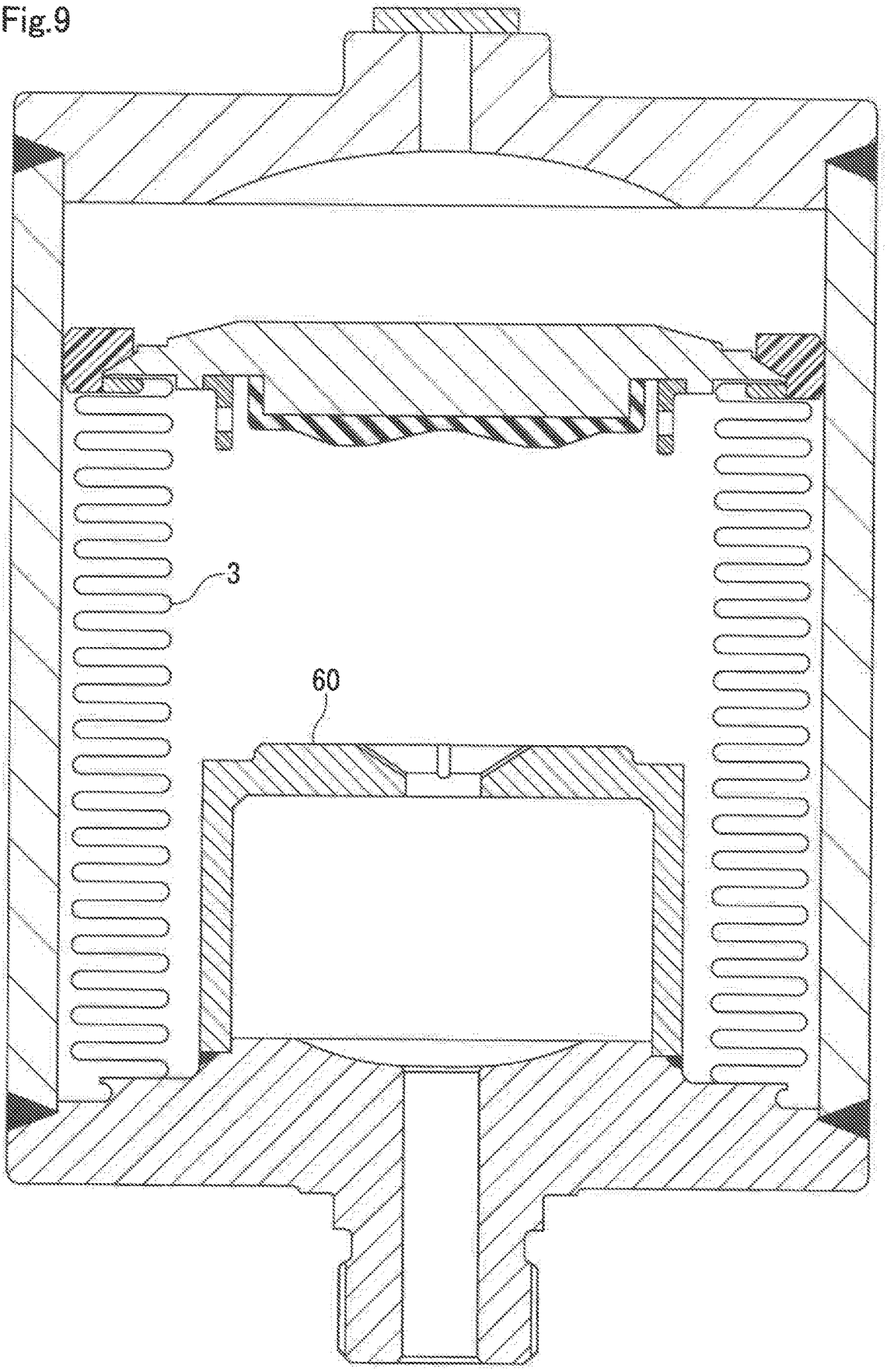
FIG. 9 is a sectional view showing a gas-outside type accumulator, as an example of an accumulator according to the present invention, in which a liquid chamber is set on the inside of a bellows and a gas chamber is set on the outside of the bellows.

For example, in the above embodiments, the accumulators 1, 101, 201, 301 are described as the so-called gas-inside type accumulator in which the liquid chamber 5 is set on the outside of the bellows 3 and the gas chamber 4 is set on the inside of the bellows 3. However, the present invention is not limited to this but for example, the accumulators may be a gas-outside type accumulator in which a stay 60, etc. is provided in a bellows 3 to set a liquid chamber on the inside of the bellows and a gas chamber is set on the outside of the bellows (refer to FIG. 9).

In the above embodiments, the housing 2 is formed by the cylindrical shell 21, the oil port member 22 or 322 welded and fixed so as to close the lower end of the shell 21, and the gas enclosing member 23 welded and fixed so as to close the upper end of the shell 21. However, the present invention is not limited to this but for example, a shell and an oil port member or a shell and a gas enclosing member may be integrated.

The bellows main body 31 is not limited to metal but may be made of, for example, resin, etc.

In the bellows cap described in the third and fourth embodiments, groove portions may be provided on the lower face of the projecting portion as well as the second embodiment.

The through hole 37, 237, or 337 is formed in any shape. However, in order to maintain the flow rate and strength, the through hole is preferably formed in a circular shape or a slit shape elongated in the up and down direction.

The up-down size of the spacer 34, 234, or 334 may be freely determined as long as the sealing face pressure in the sealing portion S can be properly maintained. However, preferably, in a state where the lower end portion 34*c* or 234*c* of the spacer 34 or 234, or the upper end portion 334*c* of the spacer 334 is abutted with the oil port member or the bellows cap, a separation gap between the projecting portion of the bellows cap and the sealing face is ensured.

By partially cutting out the lower end portion 34*c* or 234*c* of the spacer 34 or 234, or the upper end portion 334*c* of the spacer 334, communication recess portions providing communication between the inner diameter side and the outer diameter side may be provided. Groove portions extending in the radial direction may be provided in the oil port member or the bellows cap with which the lower end portion 34*c* or 234*c* of the spacer 34 or 234, or the upper end portion 334*c* of the spacer 334 is abutted.

REFERENCE SIGNS LIST

1 Accumulator
2 Housing
3 Bellows
4 Gas chamber
5 Liquid chamber
21 Shell

22 Oil port member
23 Gas enclosing member
24 Fluid inlet/outlet passage
24*a* Opening portion
24*b* Groove portion
25 Sealing face
26 Annular face portion
31 Bellows main body
32 Bellows cap
32*a* Projecting portion
32*d* Annular recess portion (recess portion)
34 Spacer
34*b* Tubular portion
35 Elastic body
36 Sealing member
37 Through hole (communication passage)
138 Groove portion
326 Annular face portion (recess portion)
S Sealing portion
A1 Space

The invention claimed is:

1. An accumulator comprising:

a housing having a sealing face and a fluid inlet/outlet passage; and a bellows fixed at one end to the housing such that an inner space of the housing is hermetically partitioned by the bellows into an interior and an exterior of the bellows, the bellows including a bellows main body capable of expanding and contracting and a bellows cap provided with a sealing member covered with an elastic body that is opposed to and capable of being closely attached to the sealing face of the housing, the fluid inlet/outlet passage of the housing being closed upon a close attachment of the elastic body to the sealing face, wherein the accumulator further comprises a spacer placed between the housing and the bellows cap so as to surround the sealing member, the spacer being fixed to the housing or to the bellows cap and having a communication passage providing communication between an inside and an outside of the spacer, and wherein when the elastic body is melted and burnt out and when the spacer is brought into contact with the housing or with the bellows cap, the communication passage and a space formed between the bellows cap and the sealing member substantially coincide with each other in height position of an axial direction.

2. The accumulator according to claim 1, wherein the spacer is formed in an annular shape, and the communication passage is defined by a through hole formed in the spacer so as to pass through the spacer in a radial direction.

3. The accumulator according to claim 2, wherein the spacer is provided in a recess portion of the bellows cap or the housing recessed in the axial direction.

4. The accumulator according to claim 2, wherein the spacer is fixed to the bellows cap.

5. The accumulator according to claim 2, wherein a groove portion extending in the radial direction on the inner diameter side of the spacer is provided in the bellows cap.

6. The accumulator according to claim 5, wherein the communication passage and the groove portion are aligned in the radial direction.

7. The accumulator according to claim 6, wherein the groove portion is closed by covering with the sealing member.

8. The accumulator according to claim 2, wherein the fluid inlet/outlet passage has, on a side of the inner space of the housing, an opening portion formed in a funnel shape gradually spreading toward an open end thereof.

9. The accumulator according to claim 8, wherein a groove portion extending in the radial direction on the inner diameter side of the spacer is provided in the bellows cap.

10. The accumulator according to claim 1, wherein the spacer is provided in a recess portion of the bellows cap or the housing recessed in the axial direction.

11. The accumulator according to claim 10, wherein the spacer is formed in an annular shape, the communication passage is defined by plural through holes formed in the spacer which holes pass through the spacer in a radial direction, and the plural through holes are arranged in a circumferential direction.

12. The accumulator according to claim 1, wherein the spacer is fixed to the bellows cap.

13. The accumulator according to claim 12, wherein the spacer is formed in an annular shape, the communication passage is defined by plural through holes formed in the spacer which holes pass through the spacer in a radial direction, and the plural through holes are arranged in a circumferential direction.

14. The accumulator according to claim 1, wherein the spacer is formed in an annular shape, the communication passage is defined by plural through holes formed in the spacer which holes pass through the spacer in a radial direction, and the plural through holes are arranged in a circumferential direction.

15. The accumulator according to claim 1, wherein a groove portion extending in the radial direction on the inner diameter side of the spacer is provided in the bellows cap.

16. The accumulator according to claim 15, wherein the groove portion is closed by covering with the sealing member.

17. The accumulator according to claim 15, wherein the communication passage and the groove portion are aligned in the radial direction.

18. The accumulator according to claim 17, wherein the groove portion is closed by covering with the sealing member.

19. The accumulator according to claim 1, wherein the fluid inlet/outlet passage has, on a side of the inner space of the housing, an opening portion formed in a funnel shape gradually spreading toward an open end thereof.

20. The accumulator according to claim 19, wherein a groove portion extending along an inclined portion of the funnel shape is provided.

* * * * *